United States Patent [19]

Lowe

[11] Patent Number: 5,058,231

[45] Date of Patent: Oct. 22, 1991

[54] STREET SWEEPER MAIN BROOM ASSEMBLY

[75] Inventor: James T. Lowe, Fontana, Calif.

[73] Assignee: Industrial Brush Corporation, Pomona, Calif.

[21] Appl. No.: 204,935

[22] Filed: Jun. 6, 1988

Related U.S. Application Data

[63] Continuation of Ser. No. 775,894, Sep. 12, 1985, abandoned.

[51] Int. Cl.[5] ..... A46B 9/02; A46B 9/08

[52] U.S. Cl. ..... 15/182

[58] Field of Search ..... 15/82, 179, 181, 182; 29/127; 300/21

[56] References Cited

U.S. PATENT DOCUMENTS

| | | | |
|---|---|---|---|
| 2,820,235 | 1/1958 | Nelson | 15/181 |
| 3,107,381 | 10/1963 | Tilgner | 15/182 |
| 3,750,225 | 8/1973 | Gould et al. | 15/182 |
| 3,900,915 | 8/1975 | Rosseau | 15/182 |

*Primary Examiner*—Werner H. Schroeder
*Assistant Examiner*—John J. Calvert
*Attorney, Agent, or Firm*—Christie, Parker & Hale

[57] ABSTRACT

A street sweeping broom includes a helically formed brush strip which is tightly secured about the periphery of a rigid cylindrical core. The brush strip is of conventional construction including a plurality of reversely bent bristles with the bights thereof being maintained within a channel member by an anchoring wire and by crimping the sides of the channel member at spaced locations along the length thereof. At least one end of the helical brush strip is secured to a guide member which also secures the coil directly adjacent to the end of the brush strip so that the end coil thereof may not change diameter. A ring having a plurality of circumferentially spaced slots is secured to the end of the cylindrical core and the guide member is mounted on the ring in a fashion which allows movement of the guide member about the circumference of the ring in one rotational direction only. In a preferred embodiment the opposite end of the helical brush strip is anchored to the other end of the cylindrical core by means of a clamp block attached to the core. The clamp block is configured to laterally or longitudinally receive a securing member or rod attached to the other end of the brush strip.

2 Claims, 2 Drawing Sheets

FIG_2
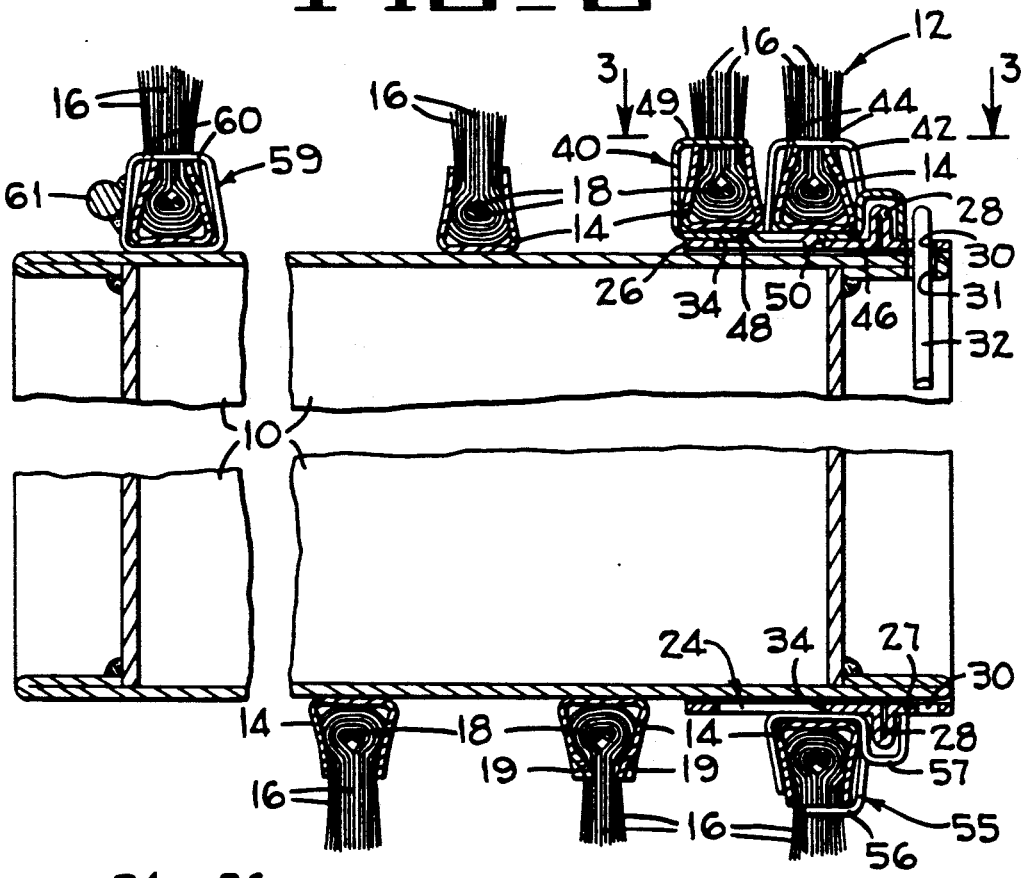
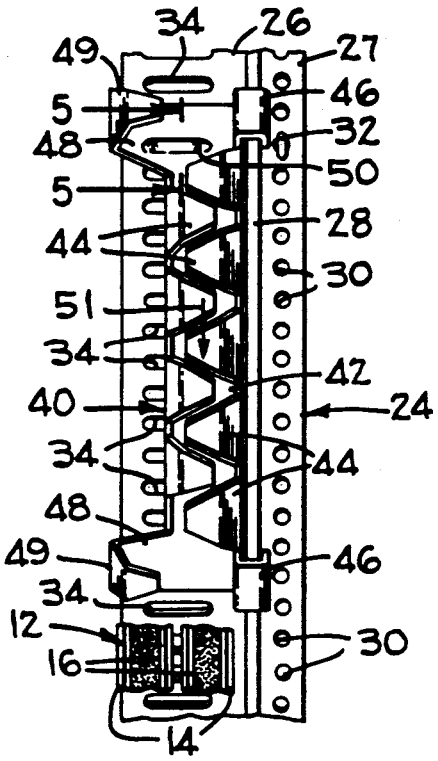
FIG_3
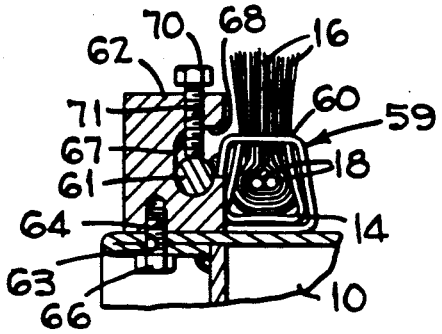
FIG_4
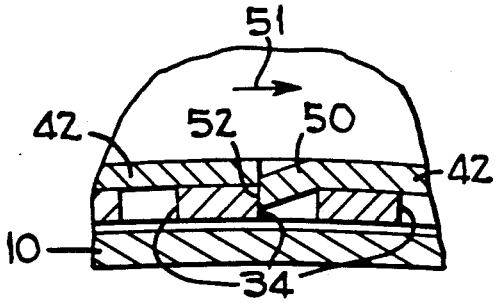
FIG_5

STREET SWEEPER MAIN BROOM ASSEMBLY

This is a continuation of application Ser. No. 07/775,894, filed Sept. 12, 1985, now abandoned.

BACKGROUND OF THE INVENTION

The invention disclosed herein pertains to rotary power driven brushes of the type mounted in street sweeping machines, and more particularly pertains to structure whereby a helically coiled brush strip is maintained in tightly wound engagement upon the cylindrical surface of a rotary broom core during installation and operation.

SUMMARY OF THE INVENTION

The apparatus of this invention operates to retain a helical brush strip in position on a cylindrical brush core, wherein the core has first and second ends and the brush strip also has first and second ends disposed adjacent the first and second core ends respectively. Means is provided for fastening the first end of the brush strip adjacent to the first end of the core. Means is also provided for mounting the second end of the brush strip adjacent to the second end of the core. Capturing means engages a first turn of the helical brush strip adjacent the second end of the core, whereby the first turn cannot expand in diameter and cannot therefore come free of the means for mounting In another aspect of the invention a rotary broom includes a generally cylindrical core, a helical brush strip wound about the core, a ring member secured to one end of the core, a series of stops on the ring member spaced circumferentially thereabout, and tightening means positioned at the end of the brush strip adjacent to the ring member for engagement with the ring member so that unidirectional relative circumferential movement only is allowed between the tightening means and the ring member. The tightening means includes a guide member configured to contact and move upon the ring member and means on the guide member for engaging the stops on the ring member so that the unidirectional movement occurs. Further, means is provided on the guide member for securing thereto substantially the first full turn of the helical brush strip at the end thereof adjacent to the ring member.

BRIEF DESCRIPTION OF THE DRAWINGS

FIG. 2 is a broken section of the coiled broom assembly taken along a diameter of the broom.

FIG. 3 is a section taken along the line 3—3 of FIG. 2.

FIG. 4 is a section taken along the line 4—4 of FIG. 1.

FIG. 5 is a section taken along the line 5—5 of FIG. 3.

DESCRIPTION OF THE PREFERRED EMBODIMENTS

Figure 1:
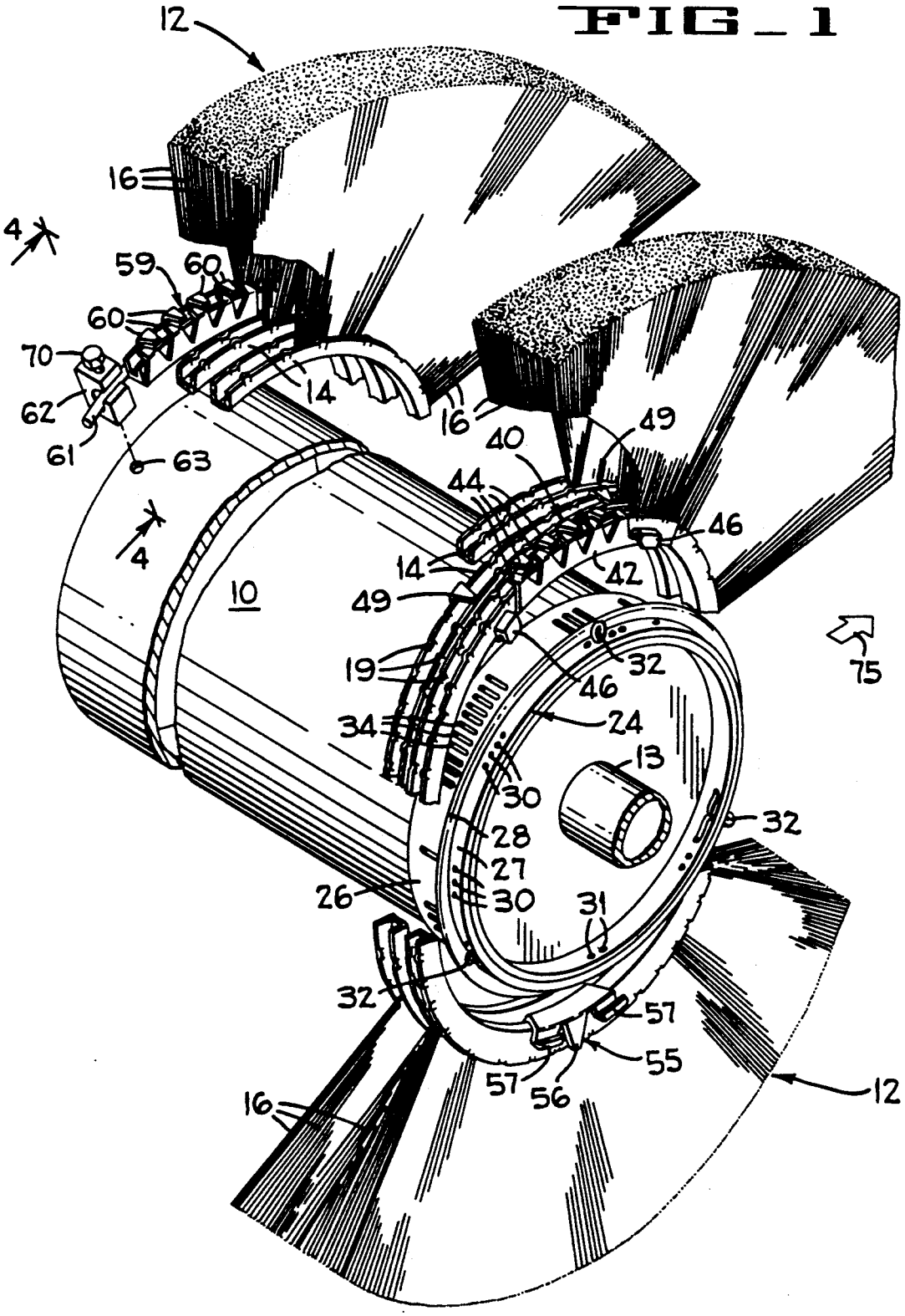
FIG. 1 is a perspective view of one end of a rotary coiled broom embodying the present invention with the continuous brush strip shown segmented and spaced from the core for the purposes of illustration.

Referring to FIGS. 1 and 2 of the drawings the cylindrical rotary broom is seen to include a generally cylindrical core 10 about which is wrapped a helical brush strip 12. The brush strip helix extends the full length of the core in closely spaced coils. An axle 13 is arranged to support the core upon a street sweeping machine (not shown) in a conventional manner. The brush strip, as shown in FIGS. 1 and 2, is conventional in construction and includes a coiled metallic supporting channel 14 within which is received a plurality of reversely bent and closely bunched bristles 16 that extend throughout the length of the brush strip. Each of the bristles is secured at the bight thereof within the supporting channel 14 by means of an anchoring wire or wires 18. The bristles are additionally retained in the channel by spaced crimped portions 19 (FIG. 1) appearing intermittently along the outer side edges of the channel 14. It has been found that the spaced crimped portions are only required on the first and second ends of the brush strip if the channel is properly closed.

Structure is provided whereby at least one end of the brush strip 12 is secured to one end of the core 10 so that continuous positive accumulation of slack within the brush strip is obtained. To accomplish this a cylindrical ring member 24 is configured to fit about the end surface of the cylindrical core. The ring member has a relatively wide cylindrical flange portion 26 and a relatively narrow cylindrical flange portion 27. The flange portions are separated by a radially outward extending track portion 28. The narrow flange portion 27 is positioned adjacent to the end of the core 10 and is provided with a series of apertures 30 spaced about its circumference. Spaced apertures 31 are formed in the end of the cylindrical core so that selected ones of the apertures 30 may be aligned with apertures 31 to mutually receive cotter pins 32 therethrough in order to permit the attachment of the ring member to the core. The wide flange portion 26 of the ring member has formed therein a continuous series of uniformly spaced elongated slots 34 which extends about the entire periphery of the wide flange portion.

The end of the brush strip 12 is securely attached to a clip or guide member 40 that is configured to ride upon the track portion 28 of the ring member 24. The guide member 40 is also provided with means whereby it is permitted to move in only one rotary direction upon the surface of the ring member. With reference to FIGS. 2 and 3 of the drawings, a guide member 40 is shown which has a generally U-shaped body portion 42 arranged to receive the end of the brush strip. The side walls of the body portion 42 on the guide member are provided by a plurality of tabs 44, the upper ends of which are bent transversely from opposite sides of the body portion 42 to overlie the channel formed within the U-shaped body. The tabs 44 thus positioned in closely spaced adjacent relationship, securely lock the channel 14 of the brush strip within the channel formed by the U-shaped body 42 of the guide member. A pair of reversely bent ears 46 extend laterally outward from the body portion 42 of the guide member and are formed to be slidably received upon the track portion 28 of the ring member so that the guide member can freely slide along the track about the circumference of the ring member.

A pair of flanges 48 at the ends of the guide member extend laterally in the opposite direction from that in which the ears 46 extend, and as shown in FIG. 2 of the drawings, underlie and support the brush strip channel 14 at a position on the helix spaced substantially one coil length from the end of the brush strip 12 (FIG. 2), Extending upwardly from the flanges 48 are tabs 49 or tangs which are sufficiently long to be bent inwardly over the helical brush channel 14 at the position about one turn away from the end of the helical brush. The tabs 49 when bent inwardly, overlie the flanges 48 and capture the channel 14 therebetween. Prior to capturing the first turn of the helical brush strip 12, the turn is reduced in diameter to just fit about the periphery of the core 10 and the hardware mounted at the end of the core 10. This diameter is generally less than the outer diameter of the track portion 28 of the cylindrical ring member 24. The end turn of the helical brush strip 12 is therefor prevented from expanding in diameter, but may decrease in diameter (limited by the structure surrounded by the end turn) as the guide member 40 moves on the ring member 24 as hereinafter described. This arrangement serves to properly maintain the end turn of the brush strip coil close to the end of the core and at a maximum diameter. It should be noted that a number of end turns on the helical brush strip 12 might be individually or collectively captured by tabs attached to the guide member 40 if a plurality of flanges 48 are provided on the guide member extending in length in multiples of the width of the brush strip channel 14.

An inwardly struck tang 50 is formed at the bottom of the channel formed by the body portion 42 on the guide member 40. The tang 50 extends rearwardly when referred to the direction of allowed travel of the guide member on the ring member 24 and is inclined at an angle to the direction of travel. The tang is arranged to successively become engaged in the spaced slots 34 of the ring member as the guide member slides about the periphery of the ring. The tang configuration is such that it will pass over the slots when the guide member and the end turn of the brush strip held thereby are moved in one rotary direction as indicated by the arrow 51 shown in FIGS. 3 and 5 of the drawings. Movement of the guide member 40 and therefore the end turn of the brush strip 12 is prevented in the opposite direction due to engagement of a flat radially extending face 52 on the tang 50 with the trailing side edge of one of the slots 34. The trailing side edges of the slots therefore serve as stops for the guide member. FIG. 5 demonstrates most clearly the locking engagement of the tang face 52 with the slot edges in the ring member.

As is current practice, to further insure that the end coil of the brush strip will be maintained in the proper relationship with respect to the adjacent end of the supporting core, a second guide clip 55 is seen in FIGS. 1 and 2. The second guide clip is secured to the brush strip at a position spaced approximately one-half of a coil length from the end of the strip. The second clip 55 is a U-shaped member, one side wall of which is formed by a tab or tang 56 that is bent at the upper edge thereof so as to overlie the channel 14 of the brush strip and lock the brush strip thereto. The clip 55 also includes a pair of laterally extending reversely bent ears 57 adjacent to the tab 56, whereby the guide member 55 when assembled rides upon the track portion 28 of the ring member 24 in the same manner as for the guide member 40.

With reference now to FIGS. 1, 2 and 4 the manner in which the end of the helical brush strip 12 opposite to that engaged by the guide member 40 will be described. A tang member 59 forms a U-shaped channel having upwardly extending tabs 60 on both sides of the channel. The filled brush strip assembly 12 is placed in the channel formed by the tang member 59 and the tabs are bent inwardly to overlie the bottom of the channel and capture the end of the helical brush strip therein. The tang assembly also includes a curved rod 61 which is welded, braised or otherwise securely attached to the outer edge of the U-shaped channel and which extends beyond the end of the channel. A clamping block 62 is provided with a threaded hole 64 (FIG. 4) in the bottom thereof which is brought into registration with a hole 63 adjacent the end of the core 10 opposite from the core end on which the ring member 24 is mounted. A bolt 66 or some other type of fastener is passed through the hole 63 to engage the threaded hole in the bottom of the clamping block 62 to fix the block to the end of the core 10. An opening 67 is formed through the clamping block 62 which is configured to receive the rod 61 therethrough. Rod 61 must be sufficiently rigid to hold the end coil securely in place so that it does not shift away from the end of the core. As may also best seen with reference to FIGS. 1 and 4, a slot 68 is formed in one side of the clamping block which intersects the opening 67. In this fashion the rod 61 may be positioned within the opening 67 by either passing the rod longitudinally along the opening or inserting it laterally into the opening through the slot 68. Slot 68 may also be deleted, leaving only circular opening 67 into which rod 61 must be passed longitudinally. The rod once positioned in the opening is thereafter clamped against one side of the opening by means of a threaded member such as a bolt 70 which engages threads in a threaded hole 71 formed through the top of the clamping block 62.

Alternatively, the end of the brush strip 12 shown engaged by the tang assembly 59 in the figures may be replaced by a configuration including the ring member 24 and guide member 40 attached to the end of the cylindrical core 10 currently shown accepting the clamp block 62. While the assembly including the ring member 24 and guide member 40 in FIG. 1 takes up slack in the helical brush strip 12 when the guide member 40 moves in a clockwise direction as viewed in FIG. 1, such an assembly mounted at the opposite end of the core 10 is configured to take up slack in the helical brush strip 12 by moving in a counterclockwise direction as shown in FIG. 1. This latter embodiment utilizing a captured first full turn adjacent each end of the cylindrical core 10 would be useful from an assembly and/or a commonality of parts standpoint. The forward direction for a street sweeper utilizing the cylindrical brush assembly shown in FIG. 1 is in the direction of the arrow 75 so that debris is swept forwardly of the sweeper for pickup after being loosened by the brush from the surface being swept.

Although the best mode contemplated for carrying out the present invention has been herein shown and described, it will be apparent that modification and variation may be made without departing from what is regarded to be the subject matter of the invention.

What is claimed is:

1. In a rotary broom including a generally cylindrical core, a helical brush strip wound about the core, a ring member secured to one end of the core, a series of stops on the ring member spaced circumferentially thereabout, and tightening means positioned at the end of the brush strip adjacent to the ring member for engagement with the ring member so that unidirectional relative circumferential movement only is allowed between the tightening means and the ring member, the improvement wherein the tightening means comprises a guide member configured to contact and move upon the ring member;

means on said guide member for engaging the stops on the ring member so that only the unidirectional movement occurs;

means on said guide member for securing thereto substantially the first full turn of the helical brush strip at the end thereof adjacent the ring member;

a rod fixed to the end of the helical brush remote from said first full turn thereof; and clamping means attached to the other end of the core for fixing said rod thereto, wherein said clamping means has a laterally disposed opening therein for accepting said rod laterally.

2. Apparatus for retaining a helical brush strip in position on a cylindrical brush core, wherein the core has first and second ends and the brush strip has first and second ends disposed adjacent the first and second core ends, respectively, comprising means for fastening the first end of the brush strip adjacent the first end of the core;

means for mounting the second end of the brush strip adjacent the second end of the core; and capturing means for engaging a first turn of the helical brush strip at the second end thereof, whereby said first turn cannot expand in diameter and come free of said means for mounting, wherein said means for fastening comprises a clamp body mounted adjacent the first end of the core, and clamping means mounted in said clamp body, said clamp body having a lateral opening therein providing access to said clamping means, whereby the first end of the brush strip is movable laterally for engagement by said clamping means.

* * * * *

UNITED STATES PATENT AND TRADEMARK OFFICE

CERTIFICATE OF CORRECTION

PATENT NO. : 5,058,231

DATED : October 22, 1991

INVENTOR(S) : James T. Lowe

It is certified that error appears in the above-identified patent and that said Letters Patent is hereby corrected as shown below:

Column 1, line 5, change "07/775,894" to -- 06/775,894 --.

Column 1, line 29, after "mounting" insert a period.

Column 2, line 65, after "FIG. 2)" change the comma to a period.

Signed and Sealed this

Thirtieth Day of March, 1993

*Attest:*

STEPHEN G. KUNIN

*Attesting Officer*

*Acting Commissioner of Patents and Trademarks*